US010436410B2

(12) United States Patent
Mayer

(10) Patent No.: US 10,436,410 B2
(45) Date of Patent: Oct. 8, 2019

(54) LIGHTING DEVICE FOR A MOTOR VEHICLE HEADLIGHT

(71) Applicant: ZKW GROUP GMBH, Wieselburg (AT)

(72) Inventor: Matthias Mayer, Mank (AT)

(73) Assignee: ZKW GROUP GMBH, Wieselburg (AT)

( * ) Notice: Subject to any disclaimer, the term of this patent is extended or adjusted under 35 U.S.C. 154(b) by 20 days.

(21) Appl. No.: 15/740,610

(22) PCT Filed: Jun. 21, 2016

(86) PCT No.: PCT/AT2016/050216

§ 371 (c)(1),
(2) Date: Jan. 23, 2018

(87) PCT Pub. No.: WO2017/000009

PCT Pub. Date: Jan. 5, 2017

(65) Prior Publication Data

US 2018/0187857 A1 Jul. 5, 2018

(30) Foreign Application Priority Data

Jun. 30, 2015 (AT) ..... A 50572/2015

(51) Int. Cl.
*F21S 41/675* (2018.01)
*F21S 41/14* (2018.01)
(Continued)

(52) U.S. Cl.
CPC ..... *F21S 41/675* (2018.01); *F21K 9/64* (2016.08); *F21S 41/14* (2018.01); *F21S 41/16* (2018.01);
(Continued)

(58) Field of Classification Search
CPC ..... F21S 41/675; F21S 41/176; F21S 41/14; F21S 41/16; F21S 41/192; F21S 41/32;
(Continued)

(56) References Cited

U.S. PATENT DOCUMENTS 5,758,943 A 6/1998 Shirai et al.
8,939,619 B2 1/2015 Shibata
(Continued)

FOREIGN PATENT DOCUMENTS

EP 2484555 A1 8/2012
EP 2508795 A2 10/2012
(Continued)

OTHER PUBLICATIONS

Search Report issued in Austrian Application No. A 50572/2015, completed May 27, 2016 (1 page).
(Continued)

*Primary Examiner* — Anabel Ton
(74) *Attorney, Agent, or Firm* — Eversheds Sutherland (US) LLP

(57) ABSTRACT

A lighting device (1) for a motor vehicle headlight, having at least one illumination module (2) for emitting visible light, at least one optical component (3) deflecting and/or shaping the light of the illumination module (2) and a holding module (4) which is connected with the illumination module (2) and in which the at least one optical component (3) is supported, the illumination module (2) comprising at least one laser light source (2*a*) and a light conversion element (2*b*), the light of the at least one laser light source (2*a*) being directed onto the light conversion element (2*b*), which converts the light into visible light and emits it into the optical component (3), the holding module (4) having at least one first and one second guidance means (4*b'*, 4*h*), the first guidance means (4*b'*) being able to move the optical component (3) in a first direction (x) with respect to the light conversion element (2*b*), and the second guidance means (4*h*) being able to move the optical component (3) in a second direction (z), the first and the second directions (x, z) being different from one another.

19 Claims, 4 Drawing Sheets

(51) Int. Cl.

| | |
|---|---|
| ***F21S 41/39*** | (2018.01) |
| ***F21S 41/32*** | (2018.01) |
| ***F21S 45/47*** | (2018.01) |
| ***F21S 41/16*** | (2018.01) |
| ***F21K 9/64*** | (2016.01) |
| ***F21S 41/176*** | (2018.01) |
| ***F21S 41/19*** | (2018.01) |
| ***F21V 7/07*** | (2006.01) |

(52) U.S. Cl.
CPC ..... *F21S 41/176* (2018.01); *F21S 41/192* (2018.01); *F21S 41/32* (2018.01); *F21S 41/39* (2018.01); *F21S 45/47* (2018.01); *F21V 7/07* (2013.01)

(58) Field of Classification Search
CPC ..... F21S 41/39; F21S 41/635; B60Q 1/068; B60Q 1/0683; B60Q 1/0686; B60Q 1/072
See application file for complete search history.

(56) References Cited

U.S. PATENT DOCUMENTS

| | | | | |
|---|---|---|---|---|
| 9,182,104 | B2 | 11/2015 | Letoumelin et al. | |
| 9,458,976 | B2 | 10/2016 | Krenn et al. | |
| 2008/0008427 | A1 | 1/2008 | Takeda et al. | |
| 2014/0268846 | A1* | 9/2014 | Nakazato | B60Q 1/0023 362/510 |
| 2015/0117043 | A1* | 4/2015 | Shibata | B60Q 1/0683 362/512 |
| 2016/0332558 | A1* | 11/2016 | Mayer | H01S 5/005 |
| 2016/0347236 | A1* | 12/2016 | Yatsuda | B60Q 1/085 |

FOREIGN PATENT DOCUMENTS

| | | | |
|---|---|---|---|
| EP | 2620693 | A2 | 7/2013 |
| JP | H0855501 | A | 2/1996 |
| JP | 2007005090 | A | 1/2007 |
| JP | 2014225411 | A | 12/2014 |

OTHER PUBLICATIONS

International Search Report for PCT/AT2016/050216, dated Oct. 6, 2016 (2 pages).

English Translation of Office Action for Japanese Application No. 2017-568036, dated Oct. 16, 2018 (4 pages).

* cited by examiner

LIGHTING DEVICE FOR A MOTOR VEHICLE HEADLIGHT

The invention relates to a lighting device for a motor vehicle headlight having at least one illumination module for emission of visible light, at least one optical component deflecting and/or shaping the light of the illumination module, and a holding module which is connected with the illumination module and in which the at least one optical component is supported, the illumination module comprising at least one laser light source and a light conversion element, the light of the at least one laser light source being directed onto the light conversion element, which converts the light into visible light and emits it into the optical component.

In addition, the invention relates to a motor vehicle headlight with at least one inventive lighting device.

The prior art has disclosed lighting devices in which illumination modules are solidly connected with downstream optical components, the optical component projecting the light emitted from the illumination module onto a road, for example. Therefore, the light pattern that is produced depends both on the light distribution of the illumination module and also on the optical properties of the optical component. Errors that can arise, for example, due to tolerances and inaccuracies in the manufacture of the illumination module and also the optical component, or that can be caused by inexact positioning of the optical component with respect to the illumination module, lead to deviations from a desired light pattern.

Therefore, one goal of the invention is to create a lighting device that makes it simple to produce a desired light pattern and that can do so although individual components of the lighting device can have certain manufacturing inaccuracies. This is accomplished by a lighting device of the type mentioned at the beginning in which the holding module has, according to the invention, at least one first and one second guidance means, the first guidance means being able to move the optical component in a first direction with respect to the light conversion element, and the second guidance means being able to move the optical component in a second direction, the first and the second directions being different from one another.

The invention makes it possible to move the optical component with respect to the light-emitting light conversion element so as to compensate for mispositioning of the optical component, the light conversion element, and the center of the light distribution on the light conversion element.

The displacement in the first and second directions is typically a rectilinear motion. The light of the at least one laser light source can be directed onto the light conversion element directly, or it can be directed toward the light conversion element through various optical components.

Preferably, the illumination module can comprise a housing surrounding the laser light source and the light conversion element, and the holding module can comprise a supporting element that is set up hold the optical component, the supporting element being movable with respect to the housing by means of the first guidance means, the first guidance means acting directly on the housing. The first guidance means can be, for example, track-like guide grooves, which can be arranged in an outer area of the housing, into which the supporting element engages by means of corresponding projections. This gives it an especially economical, compact, and simple structure.

Alternatively, the illumination module can comprise a housing surrounding the laser light source and the light conversion element, and the holding module can comprise a supporting element and an adapter element, the supporting element being set up hold the optical component and the adapter element being solidly connectable with the housing, the supporting element acting upon the adapter element by means of the first guidance means and being movable with respect to the adapter element. Providing an adapter element allows multiple different illumination modules to be used for the inventive lighting device, since it is simple for the adapter element to be solidly connected with the respective illumination module.

Of course displacement with respect to the housing or the adapter element implies displacement with respect to the light conversion element.

To give the lighting device an especially simple structure, the second guidance means can be arranged on the supporting element and can move the optical component with respect to the supporting element.

In particular, it can be provided that the first and the second directions be oriented normal to one another. This allows especially efficient positioning, the movements in the two directions being linearly independent of one another, making it possible to avoid undesired interactions. In the context of this disclosure, the expression "oriented normal to one another" is understood to mean an arrangement in which the included angle is between 85° and 95°.

It can be especially favorable if a movement position in each of the first and/or second directions can be determined by means of an adjusting screw. In particular, the supporting element can have an opening to hold a first adjusting screw that engages in a screw thread of the adapter element and/or of the housing of the illumination module, a first spring element arranged between the supporting element and the illumination module pressing the supporting element in the direction of the screw head of the first adjusting screw and into a rest position. This allows especially robust and simultaneously simple adjustment of the optical component in the first direction. If the illumination module has an adapter element arranged on it, of course the spring element can also be arranged between the adapter element and the supporting element. An especially practicable arrangement of the first spring element can be achieved if the first spring element is a hollow cylindrical rubber element that is arranged between the illumination module and the supporting element and that surrounds the first adjusting screw.

To prevent accidental complete unscrewing of the first adjusting screw, it can be provided that the adapter element and/or the housing of the illumination module have a first stop to limit the displacement movement of the supporting element in the direction of the spring force of the first spring element. If the adjusting screw is unscrewed far enough that a corresponding surface of the supporting element contacts the first stop, then further unscrewing of the adjusting screw leads to no further movement of the supporting element, making maximum displacement recognizable.

To prevent squashing or destruction of the first spring element, a second stop can be provided between the illumination module and the supporting element, this second stop limiting the displacement movement of the supporting element in the direction opposite the direction of the spring force of the first spring element.

It can be especially favorable if the second guidance means are arranged on the supporting element, the optical component being movable with respect to the supporting element by means of the second guidance means. It can additionally be provided that the second guidance means have at least one guide rail which projects away from the supporting element and in which the optical component is movably supported, the projecting end of the guide rail having an end element arranged on it that can be fastened to the guide rail and that limits the movement of the optical component toward the end of the guide rail, a second spring element acting on the supporting element, this second spring element pressing the optical component in the direction of the end of the guide rail and the end element having a second adjusting screw which can move the optical component against the spring force of the second spring element. This provides an especially robust and simultaneously simple arrangement for displacing the optical component in the second direction.

It can be especially favorable if the optical component has an adjustment bevel on which a section of the second adjusting screw lies, this section of the second adjusting screw also being referred to below as a contact section, the adjustment bevel and the contact section being arranged to convert axial displacement of the second adjusting screw into a displacement movement of the optical component in the second direction or opposite the second direction. The contact section is preferably cone-shaped. It can be especially advantageous if the second adjusting screw passes through the end element, which has the screw head of the adjusting screw arranged on one side of it and the contact section arranged on the opposite side of it, the contact section having a stop face facing the end element, the screw head preferably also having a stop face facing the end element. The stop faces limit the respective movement.

To allow an especially simple adjustment by an adjustment tool controlled by a user or by a robot arm, it can be provided that the first and second adjusting screws are oriented essentially parallel to one another, which allows both adjusting screws to be adjusted from a common direction.

To facilitate the adjustment process and suggest a starting value for manual adaptation, it can be provided that the illumination module have reference marks arranged on it, which indicate a neutral position of the displacement in the first and second directions, the reference marks being visible from at least one common direction, which preferably is oriented parallel to the adjusting screws. The reference marks can be arranged on the supporting element, for example. A neutral position is understood to be that position of the optical component with respect to the light conversion element in the first and second directions in which the desired light pattern is achieved if the entire lighting device is free of inaccuracies in manufacturing and assembly.

In particular, the optical component can comprise a lens and/or a reflector, in particular a hyperbolic reflector with a lens.

In addition, a separate heat sink can be arranged on the illumination module.

In addition, the invention relates to a motor vehicle headlight with at least one inventive lighting device.

The invention is explained in detail below using a non-restrictive sample embodiment, which is illustrated in the figures. The figures are as follows.

Figure 1:
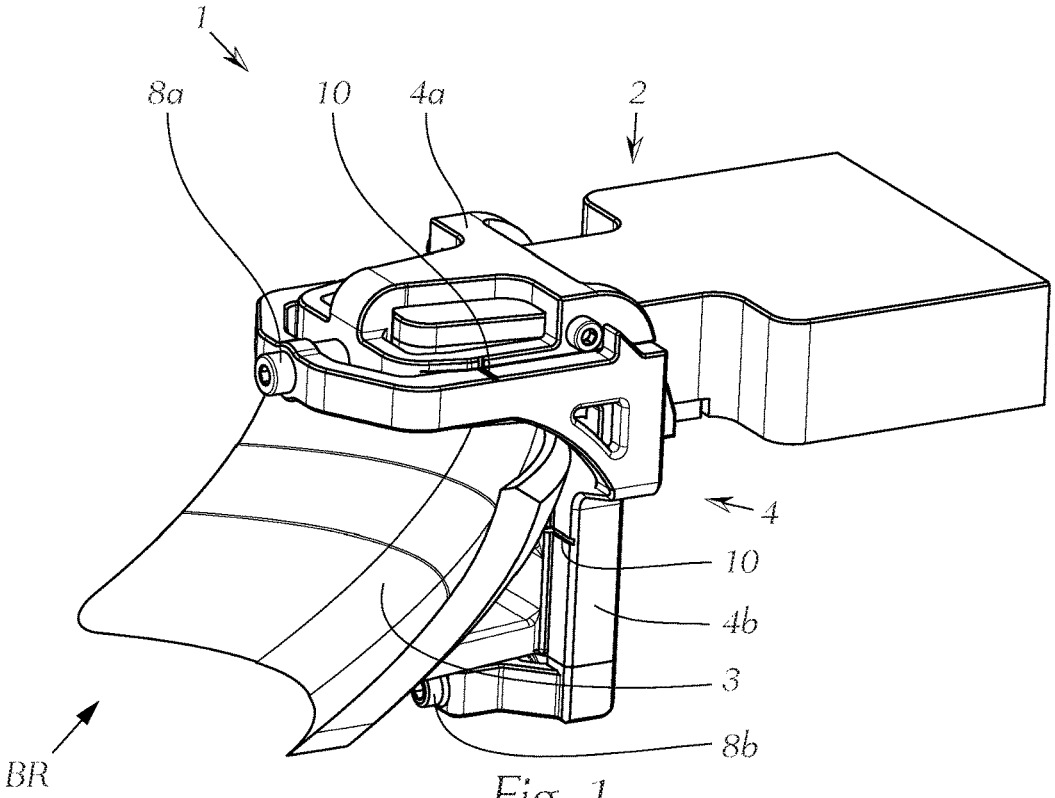
FIG. 1 is a perspective representation of the inventive lighting device.
Figure 3:
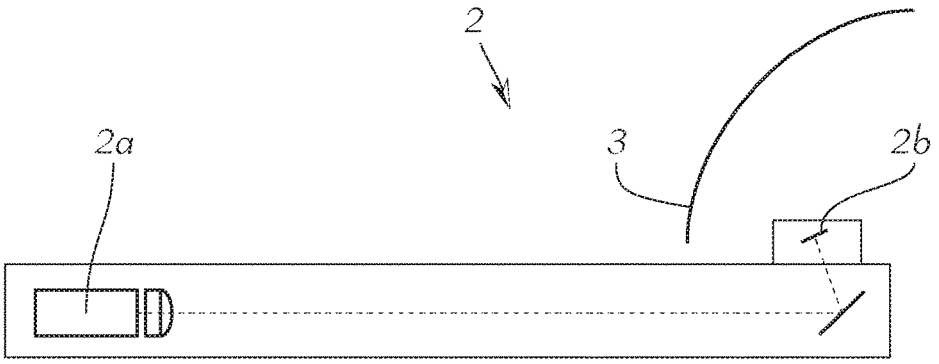
FIG. 3 is a schematic representation of the illumination module according to FIG. 2.

FIG. 1 is a perspective representation of the inventive lighting device 1 for a motor vehicle headlight having at least one illumination module 2 for emitting visible light, an optical component 3 deflecting and/or shaping the light of the illumination module 2, the optical component 3 in the embodiment shown being in the form of a reflector. The optical component 3 can also be a lens system consisting of at least one lens, combinations of lenses and/or reflectors, or in theory any other optical components that are suitable to form a light pattern for illumination purposes. The lighting device 1 also has a holding module 4 connected with the illumination module 2, the holding module 4 in the embodiment shown having two components, namely an adapter element 4*a* and a supporting element 4*b*, which interact as described below. The holding module 4 is set up to hold the optical component 3 so that it is movable. As can be seen especially in FIG. 3, which is a schematic representation of the illumination module 2, this illumination module 2 comprises at least one laser light source 2*a* and a light conversion element 2*b* (e.g., a phosphor), the light of the at least one laser light source 2*a* being directed onto the conversion element 2*b*, which converts the laser light into visible light and emits it into the optical component 3. Commonly used illumination modules 2 frequently comprise multiple laser light sources 2*a*, whose concentrated laser light is directed onto a conversion element 2*b*.

The holding module 4 has, as is discussed in greater detail in relation to the following Figures, guidance means 4*b*' and 4*h* which can displace the optical component 3 with respect to the conversion element 2*b* in a first direction x and a second direction z, the directions x and z being different from one another.

Figure 2:
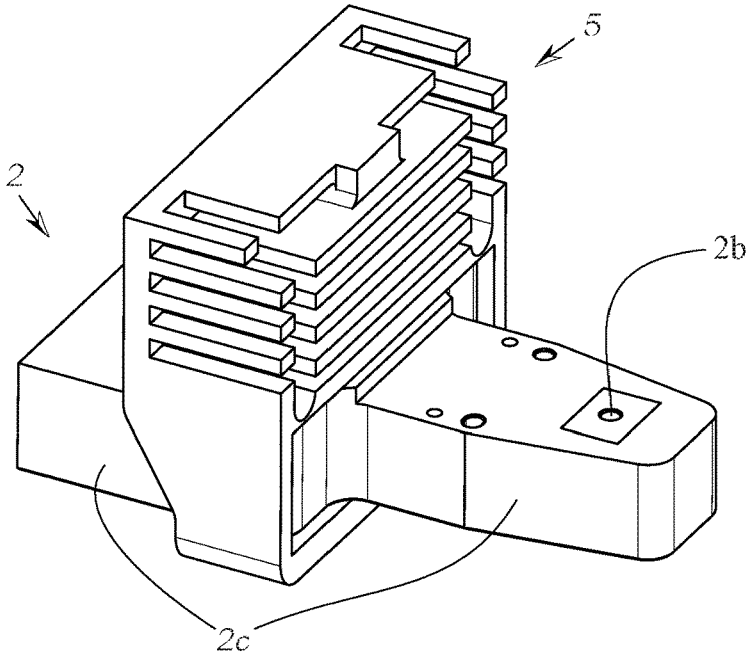
FIG. 2 is a perspective representation of an illumination module.

FIG. 2 is a perspective representation of the illumination module 2, which additionally has a heat sink 5 to cool its electronic components, the heat sink 5 being omitted from the following figures to give a better overview. The laser light source 2*a* is enclosed by a housing 2*c*, which surrounds the light conversion element 2*b*.

Figure 4:
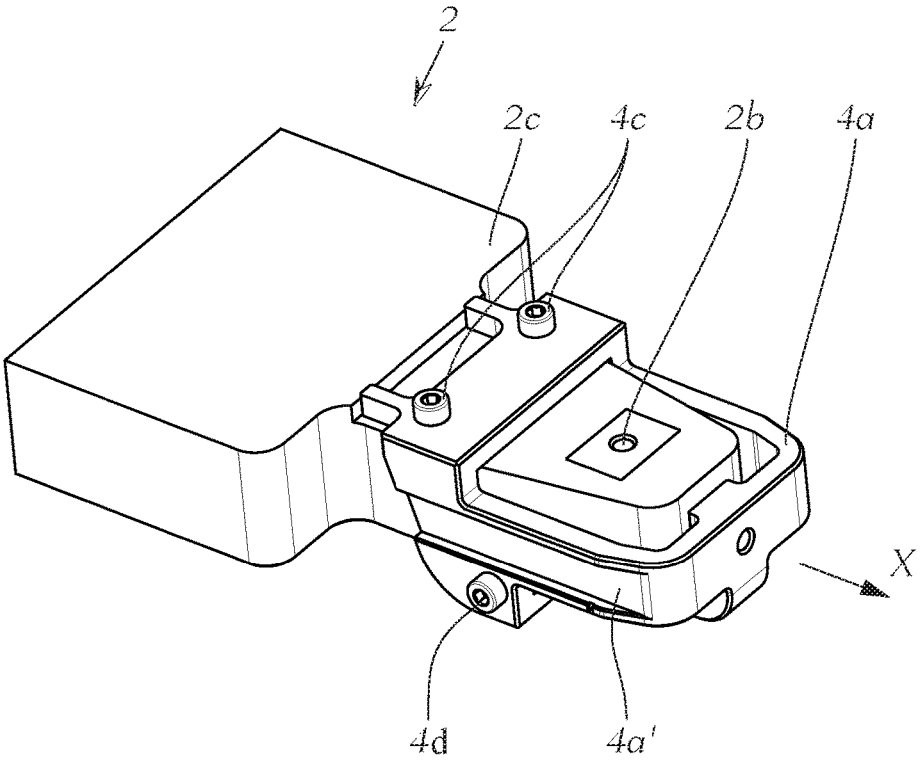
FIG. 4 is a perspective representation of the illumination module with an adapter element arranged in it.

FIG. 4 is a perspective representation of the illumination module 2 with an adapter element 4*a* arranged on it. The adapter element 4*a* is pushed onto the illumination module 2 and fastened, for example by means of screws 4*c* or other suitable means, to the illumination module 2, so that the adapter element 4*a* is solidly connected with the illumination module 2. Furthermore, the adapter element 4*a* has a first stop 4*d* to limit the displacement movement of the supporting element 4*b* in the direction of the spring force of a first spring element 7*a* shown in FIGS. 5 and 6. This first stop 4*d* is typically put on after assembly of the supporting element 4*b*; in the embodiment shown it is in the form of a screw. The adapter element 4*a* has, on each of its opposite sides, a depression 4*a*' that is set up to hold and guide the contact sections 4*b*' of the supporting elements 4*b* that engage into the depression 4*a*'. The first guidance means are formed by the engagement of the contact section 4*b*' into the depression 4*a*'. Of course the person skilled in the art also knows other arrangements and possibilities that allow guidance of the holding module 4 in the first direction x. For instance, instead of the depressions 4*b*', the adapter element 4*a* could have projections on it that engage into the corresponding guide grooves on the supporting element 4*b*. Embodiments are also conceivable in which the adapter element 4*a* can be omitted and the supporting element 4*b* comes in direct contact with the illumination module 2, for example if the illumination module 2 already has components, in particular projections or depressions, corresponding with the guidance means 4*b*' of the supporting element 4*b*.

Figure 5:
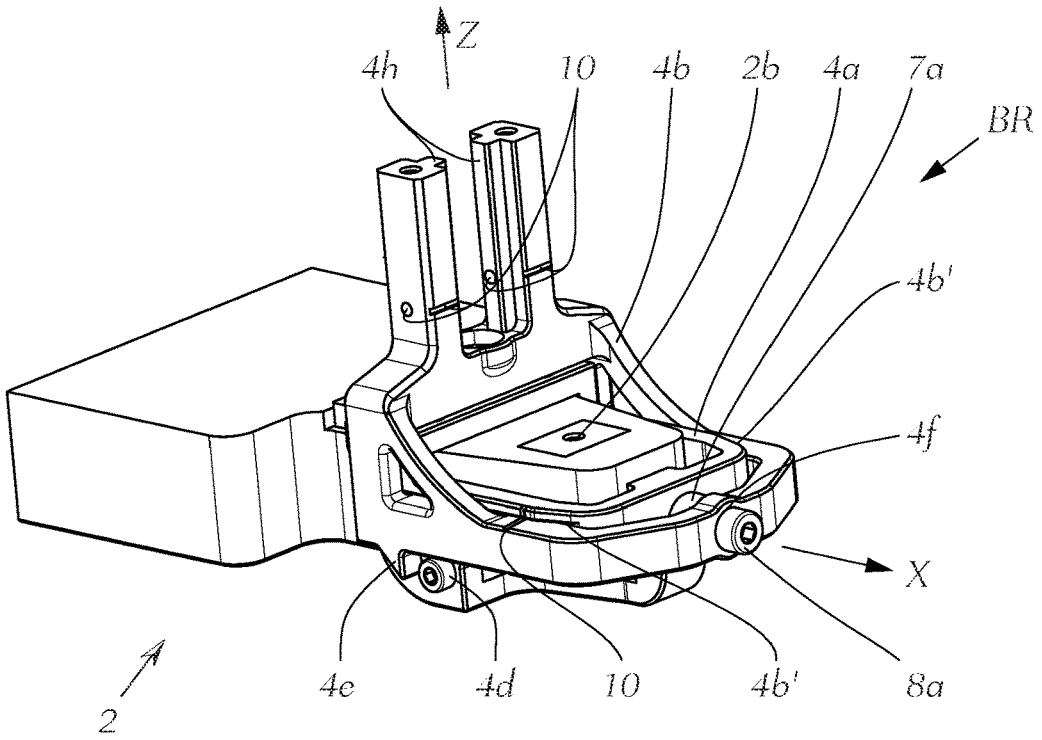
FIG. 5 is a perspective representation of the illumination module with a supporting element that acts comes in contact with the adapter element.
Figure 6:
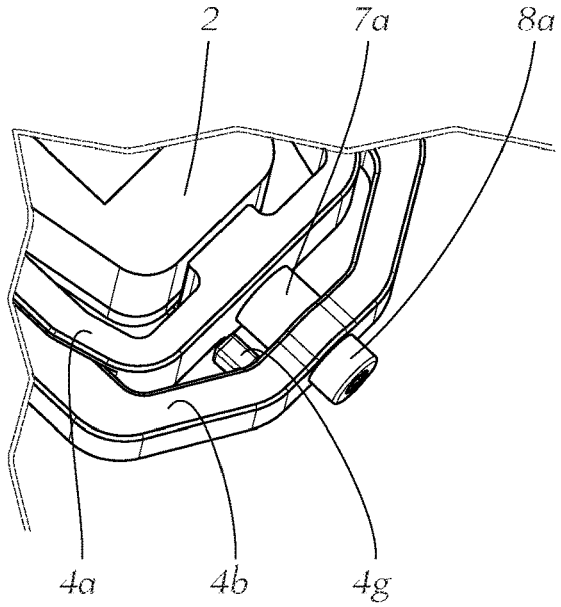
FIG. 6 is a detail view of FIG. 5.

FIG. 5 is a perspective representation of the illumination module 2 with a supporting element 4*b* that comes in contact with the adapter element 4*a*. The supporting element 4*b* is supported on the adapter element 4*a* so that it is movable in the first direction x, and it has a projection 4*c* that is set up to make contact with a first stop 4*d* when the supporting element 4*b* is at a maximum displacement, and thus to prevent further displacement in the first direction X. Furthermore, the supporting element 4*b* has an opening 4*f* to hold a first adjusting screw 8*a*, which screws into a screw thread of the adapter element 4*a* and/or of the housing 2*c* of the illumination module 2, the adapter element 4*a* and the illumination module 2 having a first spring element 7*a* arranged between them. The first spring element 7*a* is set up to press the supporting element 4*b* in the direction of the screw head of the adjusting screw 8*a*, into a rest position, and is in the form of a hollow cylindrical rubber element arranged between the illumination module 2 or adapter element 4*a* and the supporting element 4*b* that surrounds the adjusting screw 8*a*. FIG. 6 shows a detail view of this.

This figure shows a second stop 4*g* that is arranged between the illumination module 2 or the adapter element 4*a* and the supporting element 4*b* and that limits the displacement movement of the supporting element 4*b* in the direction opposite the direction of the spring force of the first spring element 7*a*. This can prevent excessively strong squashing of the spring element 7A and resulting damage. The two stops 4*d* and 4*g* can limit the adjustment range for displacement of the supporting element 4*b* with respect to the housing 2*c* and for displacement of the conversion element 2*b* arranged in it to a useful amount.

For displacement of the optical component 3 in a second direction z, a second guidance means 4*h* is provided, which is arranged on the supporting element 4*b* and which will now be discussed in detail with reference to FIGS. 7 through 9.

In the sample embodiment shown, the second guidance means 4*h* consist of two guide rails which project away from the supporting element 4*b* and which are set up to hold the optical component 3 so that it is movable in the second direction z. Of course the second guidance means 4*h* can also have a different design, as long as they allow guidance in the second direction z. The optical component 3 is supported so that it is movable in the guide rail 4*h*, whose projecting end has, as shown in FIG. 9, an end element 9 arranged on it (or that can be fastened to the end of the guide rails), which limits the movement of the optical component 3 toward the end of the guide rails. The end element 9 has a second adjusting screw 8*b* that passes through the end element 9, which has, arranged on one side of it, the screw head of the screw 8*b* and, arranged on the opposite side, a contact section, which is cone-shaped in the sample embodiment shown. Facing the end element 9, the contact section has a stop face 8*b*" which limits the maximum adjustment of the adjusting screw 8*b* with respect to the end element 9. Moreover, the screw head can have another stop face 8*b*' facing the end element 9, it being possible in such a case for the end element 9 to be made in two pieces, to surround the adjusting screw 8*b* and hold it between the two pieces. The threaded connections by means of which the end element 9 is arranged on the guide rails 4*h*, can be used for solid connection of the two pieces.

Figure 8:
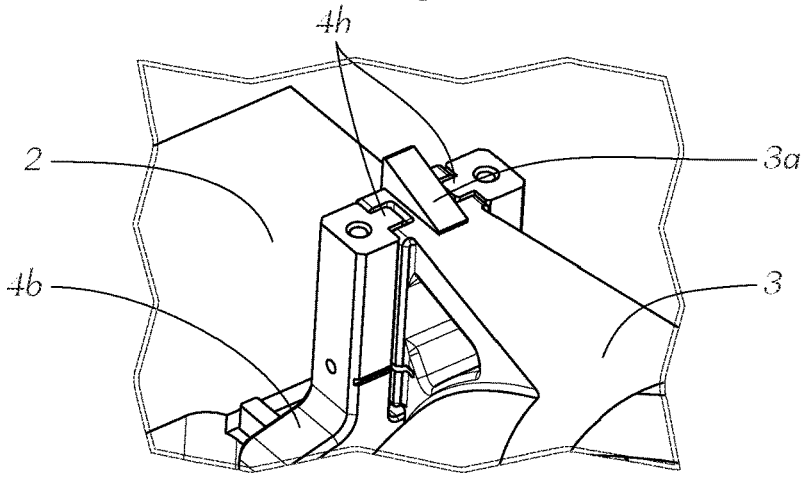
FIG. 8 is a representation of an optical component held in the supporting element of FIG. 7.
Figure 9:
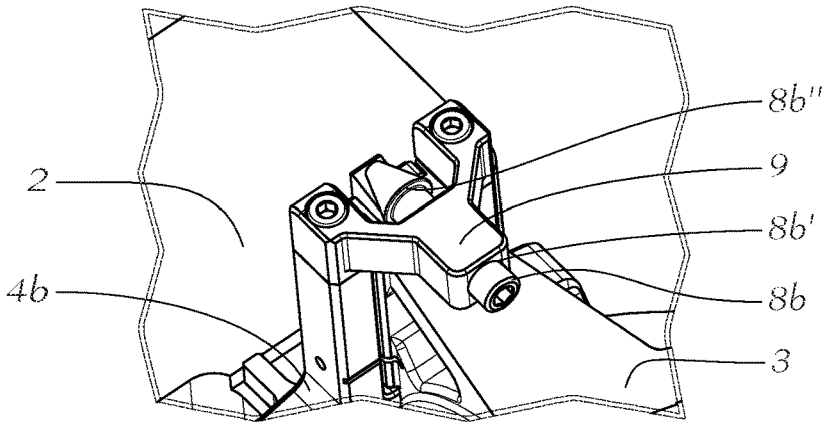
FIG. 9 is the representation according to FIGS. 7 and 8 with an end element.

As can easily be seen in FIG. 8, the optical component 3 has an adjustment bevel 3*a* on which the contact section of the second adjusting screw 8*b* lies, the adjustment bevel 3*a* and the contact section being arranged to convert axial displacement of the second adjusting screw 8*b* into a displacement movement of the optical component 3 in the second direction z, or opposite the second direction.

Figure 7:
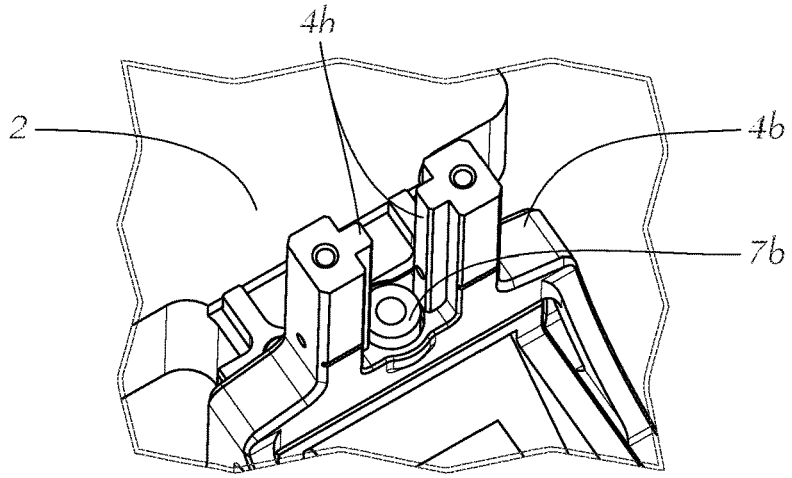
FIG. 7 is a perspective view of the supporting element, viewed at an angle from above.

In FIG. 7 it can be seen that the supporting element 4*b* has a second spring element 7*b* arranged on it, which presses the optical component 3 in the direction of the end of the guide rails 4*a*, ensuring that the adjustment bevel 3*a* is pressed against the contact section of the second adjusting screw 8*b*, thus establishing a defined rest position of the optical component 3. The second spring element 7*b* advantageously sits in a recess in the supporting element 4*b* (easily visible in FIG. 5), which first secures the position of the spring element 7*b* in the lateral direction and can additionally prevent excessively strong squashing and thus damage of the spring element 7*b*, since the supporting element 4*b* limits the displacement movement of the optical element 3 in the direction opposite the direction of the spring force of the spring element 7*b*.

As can be seen in FIGS. 5, 7, 8, and 9, there are reference marks 10 arranged on the holding module 4, in the sample embodiment shown specifically on the supporting element 4*b*, these reference marks 10 indicating a neutral position of the movement position in the first or second direction and preferably being visible from at least one common viewing direction BR. These reference marks 10 can be in the form of notches or projections, for example.

This can clearly be seen in FIG. 1, which shows the inventive lighting system 1 in an assembled state. In it, the adjusting screws 8*a* and 8*b* are oriented parallel to one another, which makes it simple for them to be reached by a user, without this requiring access from different directions.

The inventive lighting device 1 makes it simple to adjust the optical component 3 with respect to the conversion element 2*b*, in particular to displace it in the already described first and second directions x, z, which are different from one another—preferably being oriented normal to one another. In a motor vehicle headlight with the inventive lighting device 1, the directions x and z are preferably selected so that when the vehicle headlight is installed in the vehicle the direction x coincides with the vehicle's main direction of travel (the so-called longitudinal axis of the vehicle), and the direction z corresponds to the vertical axis.

In consideration of this teaching, the person skilled in the art is able to arrive at other embodiments of the invention that are not shown. Therefore, the invention is not limited to the embodiment shown. What is essential are the ideas on which the invention is based, which can be realized in diverse ways by the person skilled in the art who knows this description, but nevertheless remain the same.

The invention claimed is:

1. A lighting device (1) for a motor vehicle headlight, comprising:

at least one illumination module (2) for emitting visible light;

at least one optical component (3) configured to deflect, to shape, or to deflect and shape the visible light emitted from the at least one illumination module (2); and a holding module (4) which is connected with the at least one illumination module (2) and in which the at least one optical component (3) is supported, wherein the at least one illumination module (2) comprises at least one laser light source (2*a*) and a light conversion element (2*b*), the at least one illumination module being configured to direct light from the at least one laser light source (2*a*) onto the at least one light conversion element (2*b*), which converts the light into visible light and emits the visible light into the at least one optical component (3), and wherein the holding module (4) has at least one first and at least one second guidance elements (4*b*', 4*h*), the at least one first guidance element (4*b*') being able to move the at least one optical component (3) with respect to the light conversion element (2*b*) in a first direction (x), and the at least one second guidance element (4*h*) being able to move the at least one optical component (3) in a second direction (z), the first and the second directions (x, z) being different from one another.

2. The lighting device (1) according to claim 1, wherein:

the at least one illumination module (2) comprises a housing (2*c*) surrounding the at least one laser light source (2*a*) and the light conversion element (2*b*);

the holding module (4) comprises a supporting element (4*b*) that is configured to hold the at least one optical component (3);

the supporting element (4*b*) is movable with respect to the housing (2*c*) by the at least one first guidance element (4*b*'); and the at least one first guidance element (4*b*') acts directly on the housing (2*c*).

3. The lighting device (1) according to claim 1, wherein:

the at least one illumination module (2) comprises a housing (2*c*) surrounding the at least one laser light source (2*a*) and the light conversion element (2*b*);

the holding module (4) comprises a supporting element (4*b*) and an adapter element (4*a*), the supporting element (4*b*) being configured to hold the at least one optical component (3) and the adapter element (4*a*) being solidly connectable with the housing (2*c*); and the supporting element (4*b*) acts upon the adapter element (4*a*, 4*a*') by the at least one first guidance element (4*b*') and is movable with respect to the adapter element (4*a*).

4. The lighting device (1) according to claim 2, wherein the at least one second guidance element (4*h*) is arranged on the supporting element (4*b*) and is configured to move the at least one optical component (3) with respect to the supporting element (4*b*).

5. The lighting device (1) according to claim 1, wherein the first and the second directions (x, z) are oriented normal to one another.

6. The lighting device (1) according to claim 1, wherein a movement position in each of the first and/or second directions (x, z) is determined by an adjusting screw (8*a*, 8*b*).

7. The lighting device (1) according to claim 3, wherein:

the supporting element (4*b*) has an opening to hold a first adjusting screw (8*a*) that engages in a screw thread of the adapter element (4*a*) and/or of the housing (2*c*) of the at least one illumination module (2); and a first spring element (7*a*) is arranged between the supporting element (4*b*) and the at least one illumination module (2) pressing the supporting element (4*b*) in a direction of a screw head of the first adjusting screw (8*a*) and into a rest position.

8. The lighting device (1) according to claim 7, wherein the first spring element (7*a*) is a hollow cylindrical rubber element that is arranged between the at least one illumination module (2) and the supporting element (4*b*) and envelops the first adjusting screw (8*a*).

9. The lighting device (1) according to claim 7, wherein the adapter element and/or the housing of the at least one illumination module (2) have a first stop (4*d*) to limit a displacement movement of the supporting element (4) in a direction of a spring force of the first spring element (7*a*).

10. The lighting device (1) according to claim 7, wherein the at least one illumination module (2) and the supporting element (4*b*) have a second stop (4*g*) arranged therebetween that limits the displacement movement of the supporting element (4*b*) in a direction opposite the direction of the spring force of the first spring element (7*a*).

11. The lighting device (1) according to claim 2, wherein the at least one second guidance element (4*h*) is arranged on the supporting element (4*b*) and is configured to move the at least one optical component (3) with respect to the supporting element (4*b*).

12. The lighting device (1) according to claim 11, wherein:

the at least one second guidance element (4*h*) comprises at least one guide rail which projects away from the supporting element (4*b*) and in which the at least one optical component (3) is movably supported;

a projecting end of the at least on guide rail comprises an end element (9) arranged thereon that is configured to be fastened to the at least one guide rail;

the end element (9) limits movement of the at least one optical component (3) toward the projecting end of the at least one guide rail;

a second spring element (7*b*) acts on the supporting element (4*b*) to press the at least one optical component (3) in a direction of the projecting end of the at least one guide rails; and the end element (9) comprises a second adjusting screw (8*b*) which is configured to move the at least one optical component (3) against a spring force of the second spring element (7*b*).

13. The lighting device (1) according to claim 12, wherein:

the at least one optical component (3) comprises an adjustment bevel (3*a*) on which a contact section of the second adjusting screw (8*b*) lies; and the adjustment bevel (3*a*) and the contact section are arranged to convert axial displacement of the second adjusting screw (8*b*) into a displacement movement of the at least one optical component (3) in the second direction (z) or opposite the second direction.

14. The lighting device (1) according to claim 13, wherein:

the second adjusting screw (8*b*) passes through the end element (9), which has a screw head of the adjusting screw (8*b*) arranged on one side thereof and the contact section arranged on an opposite side, the contact section having a stop face (8*b*') facing the end element (9); and the screw head comprises a stop face (8*b*") facing the end element (9).

15. The lighting device (1) according to claim 6, wherein first and the second adjusting screws (8*a*, 8*b*) are oriented essentially parallel to one another.

16. The lighting device (1) according to claim 2, wherein the at least one illumination module (2) has reference marks (10) arranged thereon, which indicate a neutral position of a displacement in the first and second directions (x, z) and which are visible from at least one common direction (BR), which is oriented parallel to adjusting screws (8*b*).

17. The lighting device (1) according to claim 1, wherein the at least one optical component (3) comprises a hyperbolic reflector with a lens.

18. The lighting device (1) according to claim 1, wherein a separate heat sink (5) is arranged on the at least one illumination module (2).

19. A vehicle headlight comprising at least one lighting device (1) according to claim 1.

* * * * *